US009316224B2

(12) United States Patent
Unami et al.

(10) Patent No.: US 9,316,224 B2
(45) Date of Patent: Apr. 19, 2016

(54) SCROLL EXPANDER

(71) Applicant: ANEST IWATA CORPORATION, Yokohama-shi, Kanagawa-ken (JP)

(72) Inventors: Atsushi Unami, Yokohama (JP); Tamotsu Fujioka, Yokohama (JP)

(73) Assignee: ANEST IWATA CORPORATION, Kanagaawa-Ken (JP)

( * ) Notice: Subject to any disclaimer, the term of this patent is extended or adjusted under 35 U.S.C. 154(b) by 52 days.

(21) Appl. No.: 13/868,525

(22) Filed: Apr. 23, 2013

(65) Prior Publication Data

US 2013/0302199 A1 Nov. 14, 2013

(30) Foreign Application Priority Data

Apr. 25, 2012 (JP) ..... 2012-100018

(51) Int. Cl.

| | |
|---|---|
| ***F01C 1/02*** | (2006.01) |
| ***F04C 18/00*** | (2006.01) |
| ***F01C 21/18*** | (2006.01) |
| *F04C 29/00* | (2006.01) |

(52) U.S. Cl.

CPC ..... *F04C 18/00* (2013.01); *F01C 1/0238* (2013.01); *F01C 21/18* (2013.01); *F04C 29/0078* (2013.01); *F04C 2240/603* (2013.01)

(58) Field of Classification Search

USPC ..... 418/55.1–55.6, 60, 94; 417/410.5

See application file for complete search history.

(56) References Cited

U.S. PATENT DOCUMENTS

| | | | | |
|---|---|---|---|---|
| 801,182 | A * | 10/1905 | Creux | 418/142 |
| 5,938,419 | A * | 8/1999 | Honma et al. | 418/55.4 |
| 6,953,330 | B1 * | 10/2005 | Muto | 418/60 |
| 2002/0150485 | A1 | 10/2002 | Mori et al. | |

FOREIGN PATENT DOCUMENTS

| | | | |
|---|---|---|---|
| JP | 6341381 | A | 12/1994 |
| JP | 2002-310073 | A | 10/2002 |
| JP | 2009299653 | A | 12/2009 |
| WO | 02/053916 | A1 | 7/2002 |

OTHER PUBLICATIONS

JP 6341381 English Language Machine Translation.*

Office Action mailed Dec. 11, 2015, corresponding to Japanese Patent Application No. 2012-100018.

* cited by examiner

*Primary Examiner* — Thai Ba Trieu

*Assistant Examiner* — Wesley Harris

(74) *Attorney, Agent, or Firm* — Hauptman Ham, LLP

(57) ABSTRACT

In a double rotation type scroll expander having double expansion chambers, a single integrated drive shaft is disposed to penetrate the interior of a housing, the double expansion chambers are formed by a drive scroll body and a driven scroll body, and a working medium introduction hole is provided in an axial direction of the drive shaft such that the working medium is supplied evenly to the double expansion chambers through the working medium introduction hole via a radial direction hole. The drive shaft and the drive scroll body formed integrally with the drive shaft rotate while the driven scroll body rotates synchronously with the drive scroll shaft via an interlocking mechanism.

2 Claims, 3 Drawing Sheets

SCROLL EXPANDER

RELATED APPLICATIONS

The present application is based on, and claims priority from, Japanese Application Number JP 2012-100018, filed Apr. 25, 2012, the disclosure of which is hereby incorporated by reference herein in its entirety.

BACKGROUND OF THE INVENTION

1. Field of the Invention

The present invention relates to a double rotation type scroll expander in which a drive scroll body and a driven scroll body rotate synchronously.

2. Description of the Related Art

Conventional power generation systems tend mostly to be large scale plants generating at least several hundred kW, while small scale power generation is performed mostly by simply structured engine power generators and the like. Recently, however, due to increased awareness of the need for energy conservation, passage of the Act on Special Measures Concerning Procurement of Renewable Electric Energy by Operators of Electric Utilities, and the like, a need and a market for small scale power generation are gradually increasing. Photovoltaic generation and wind force power generation, on the other hand, have not yet improved in cost-effectiveness. Meanwhile, a binary power generation system that uses hot water or steam at 75 to 150° C. as a heat source to drive a small scale power generator via a working medium having a low boiling point has been developed.

Amid these developments, a scroll expander, which obtains rotary torque for a drive shaft by supplying a high-pressure working medium to an expansion chamber, has come to attract of attention as a favorable expander for use in a small scale power generation system due to the fact that a scroll expander exhibits little torque variation. In a scroll type fluid machine, a compression chamber and an expansion chamber are formed by end plates and spiral-shaped wraps of a pair of scroll bodies. Japanese Patent Application Publication No. 2009-299653 discloses a one-side revolving type scroll expander in which one of the pair of scroll bodies is a fixed scroll body and the other is a revolving scroll body, and the expansion chamber is formed by causing the revolving scroll body to revolve relative to the fixed scroll body. A scroll type fluid machine thus configured is dynamically sealed, and therefore noise and wear tend to increase in contact sites with the end plates and the wraps forming the expansion chamber, whereby a sealing property of the expansion chamber may be impaired.

Japanese Patent Application Publication No. 1-16-341381 discloses a double rotation type scroll fluid machine. In a double rotation type scroll fluid machine, a drive scroll body and a driven scroll body are rotated synchronously via an interlocking mechanism, and therefore noise and wear in the contact sites can be reduced. In the double rotation type scroll fluid machine, the compression chamber and the expansion chamber are formed by causing the driven scroll body to rotate eccentrically relative to the drive scroll body.

The double rotation type scroll fluid machine disclosed in Japanese Patent Application Publication No. H6-341381 has a so-called "double wrap scroll structure" in which the compression chamber or the expansion chamber is formed on both surface sides of the end plate of the driven scroll body. By forming the compression chamber or the expansion chamber on both sides in this manner, a processing capacity and an output (a rotary torque) of the working medium can be increased. Further, a thrust direction load exerted on the drive scroll body and the driven scroll body can be canceled out, and therefore a support structure for the drive scroll body and the driven scroll body can be simplified.

In a double rotation type scroll expander, however, the drive scroll body and the driven scroll body are caused to rotate synchronously, and therefore a double rotation type scroll expander requires a greater driving force than a one-side revolving type scroll expander. Hence, to obtain a high output, the working medium must be supplied to the expansion chamber while preventing leakage of the working medium and pre-expansion due to a temperature reduction before the working medium is supplied to the expansion chamber. With the double rotation type, however, it is more difficult to secure a working medium supply passage that satisfies both of these conditions than with the one-side revolving type.

In the double rotation type scroll fluid machine disclosed in Japanese Patent Application Publication No. H6-341381, a drive shaft is divided into two in an axial direction, whereby a problem arises in that alignment of the axial centers of the two divided drive shafts is troublesome. Further, when the double rotation type scroll fluid machine is used as a scroll expander, the high-pressure working medium is first supplied to one expansion chamber through a high-pressure fluid introduction hole provided in one of the divided drive shafts, and then supplied to the other expansion chamber through a hole provided in a partition wall between the expansion chambers. Hence, a problem arises in that pressure loss occurs in the working medium while passing through the hole, with the result that the working medium is not supplied evenly to the two expansion chambers. Further, the driven scroll body includes a housing that covers an expansion chamber formation region, and therefore a weight of the driven scroll body increases, whereby a greater driving force is required to rotate the driven scroll body.

SUMMARY OF THE INVENTION

In consideration of these problems in the related art, an object of the present invention is to provide a double rotation type scroll expander having double expansion chambers in which axial center alignment of a drive shaft is not required, a working medium supply passage in which working medium leakage and pre-expansion due to a temperature reduction do not occur can be formed, and the working medium can be supplied evenly to the double expansion chambers.

To achieve this object, a scroll expander according to the present invention includes: a drive shaft; a drive scroll body provided integrally with the drive shaft; a driven scroll body having a rotary axis that is eccentric relative to a rotary axis of the drive shaft; an interlocking mechanism that causes the drive scroll body and the driven scroll body to rotate synchronously; and a bearing that supports the drive shaft and the driven scroll body rotatably relative to a fixed frame. The drive scroll body and the driven scroll body are caused to rotate synchronously by the interlocking mechanism.

Further, the drive scroll body includes two first endplates disposed on both sides of the driven scroll body and a spiral-shaped first wrap that projects inward respectively from the two first end plates, while the driven scroll body includes a second endplate disposed between the two first end plates of the drive scroll body and a second wrap projecting from respective surfaces of the second end plate. An expansion chamber is formed on both sides of the second endplate by the endplates and the wraps of the drive scroll body and the driven scroll body so as to be oriented in a radial direction from a central portion. By forming a double expansion chamber in this manner, an output (a rotary torque) can be increased, and a thrust direction load exerted on the drive scroll body and the driven scroll body can be canceled out, whereby a support structure for the drive scroll body and the driven scroll body can be simplified.

The drive shaft is constituted by a single drive shaft penetrating the double expansion chambers, and a working medium introduction hole is provided in the drive shaft so as to open onto a radial direction central portion of the double expansion chambers. By forming the drive shaft from a single drive shaft penetrating the double expansion chambers in this manner, axial center alignment is not required. Further, by providing the working medium introduction hole in the drive shaft thus configured, a sealing property can be improved, and pre-expansion due to a temperature reduction can be eliminated. Moreover, positioning of the opening of the working medium introduction hole provided in the double expansion chambers can be facilitated, and the working medium can be supplied to the respective expansion chambers evenly since the opening position can be selected as desired.

In the present invention, the driven scroll body preferably includes: a boss portion supported rotatably by the bearing; and an arm that extends outward from the boss portion and is joined to the second end plate. Hence, a housing provided on the driven scroll body so as to cover an entire expansion chamber formation region, such as that described in Japanese Patent Application Publication No. H6-341381, can be eliminated, whereby a weight of the driven scroll body can be reduced, enabling a reduction in an amount of driving force required to rotate the driven scroll body and a corresponding increase in the output of the scroll expander.

In the present invention, a gap that allows conjunct eccentric motion of the driven scroll body relative to the drive scroll body is preferably formed between the second end plate of the driven scroll body and the drive shaft, and an opening of the working medium introduction hole is preferably disposed in a position facing the gap and straddling the second end plate evenly. Hence, the working medium can be supplied evenly to the double expansion chambers through the single opening, and therefore the machining man-hour to form the opening can be reduced.

In the present invention, the interlocking mechanism that causes the drive scroll body and the driven scroll body to rotate synchronously is preferably constituted by a cylinder attached to one of the drive scroll body and the driven scroll body rotatably, and a shaft fixed to the other scroll body, the shaft is preferably joined to a position of the cylinder that is offset from a rotational center thereof, and an offset amount of the shaft relative to the cylinder is preferably identical to an offset amount between the rotary axis of the drive shaft and the rotary axis of the driven scroll body.

By employing the interlocking mechanism thus configured, the interlocking mechanism can be simplified and reduced in weight. Accordingly, a rotation site can be configured simply and reduced in weight, enabling a corresponding increase in the output of the scroll expander.

In the scroll expander according to the present invention, the drive shaft is constituted by a single drive shaft penetrating the double expansion chambers, and therefore axial center alignment is not required. Further, the working medium introduction hole is provided in the drive shaft, and therefore a supply passage which exhibits a favorable sealing property and in which pre-expansion due to a temperature reduction does not occur can be formed. Furthermore, positioning of the opening of the working medium introduction hole into the double expansion chambers can be facilitated, and the working medium can be supplied to the respective expansion chambers evenly since the opening position can be selected as desired.

DESCRIPTION OF THE PREFERRED EMBODIMENTS

Embodiments of the present invention will be described in detail below with reference to the drawings. Note, however, that unless specific description is provided to the contrary, dimensions, materials, shapes, relative arrangements, and the like of constituent components described in the embodiments are not intended to limit the scope of the present invention.

(First Embodiment)

Figure 1:
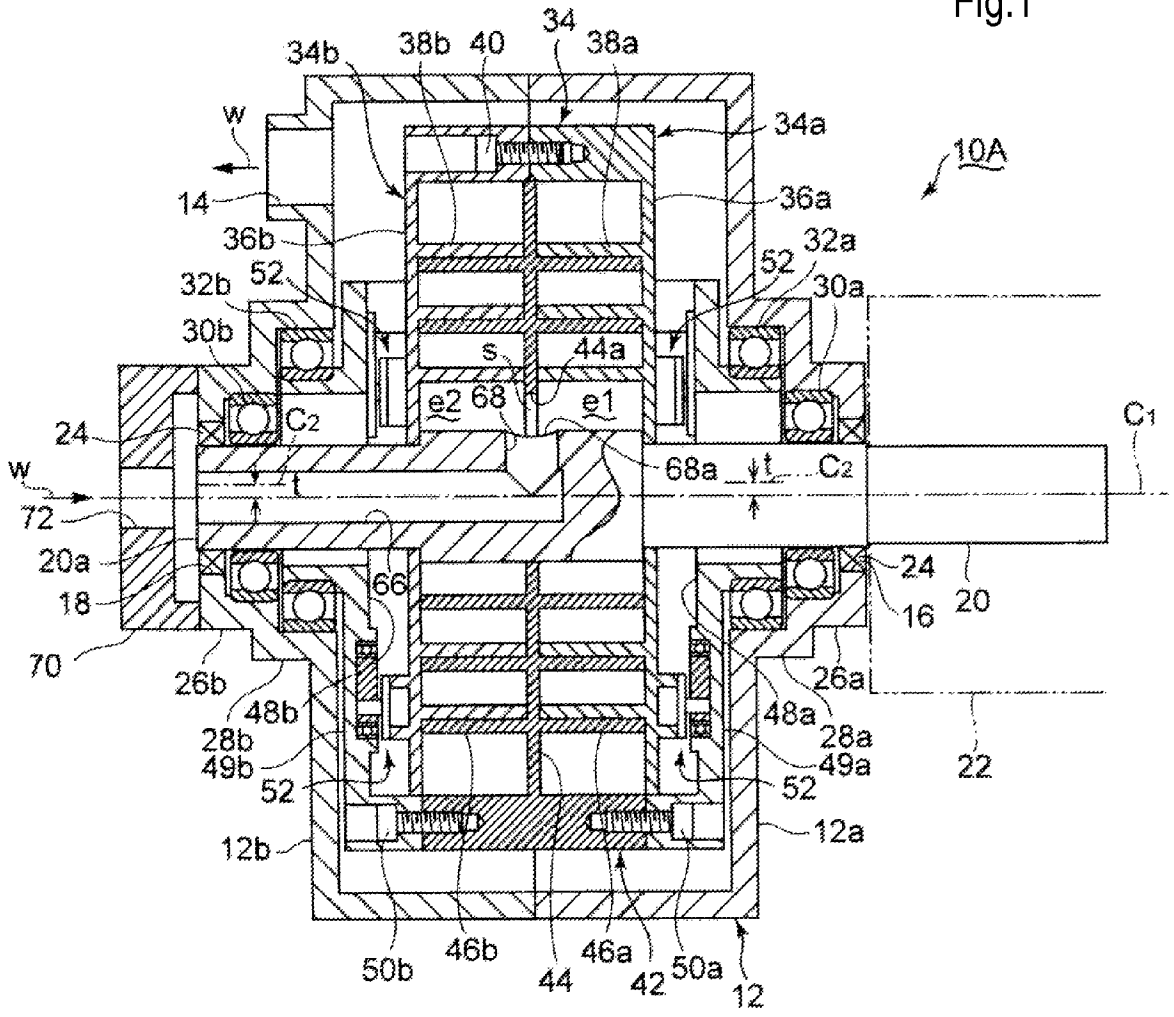
FIG. 1 is a front sectional view of a scroll expander according to a first embodiment of the present invention.
Figure 2:
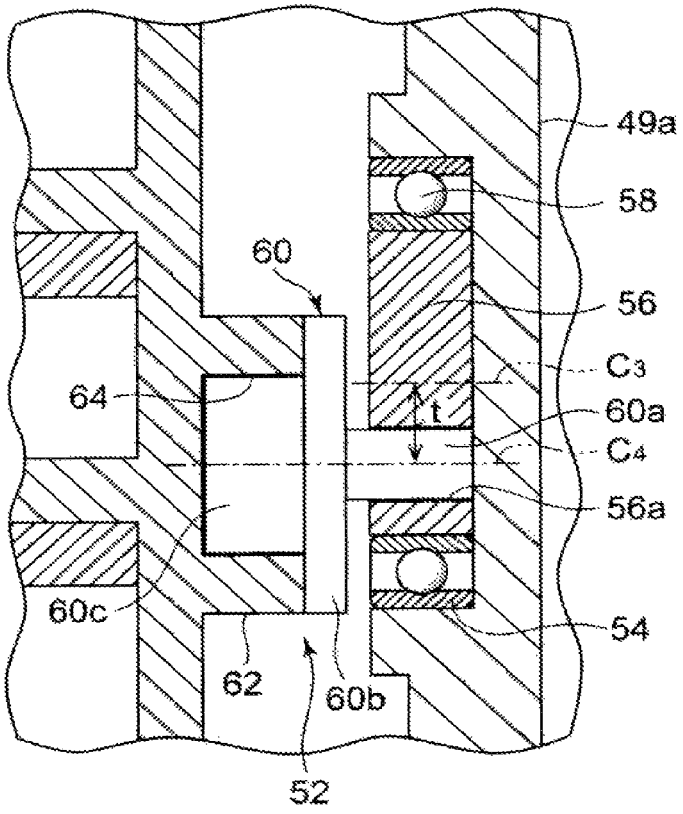
FIG. 2 is a partially enlarged view of FIG. 1.

A first embodiment of the present invention will now be described on the basis of FIGS. 1 and 2. A scroll expander according to this embodiment may be applied to the binary power generation system described above, for example. In this power generation system, a pressurized low-boiling point working medium is introduced into the scroll expander, a drive shaft of the scroll expander is rotated using an expansion force of the working medium, and power is generated by a power generator connected to the drive shaft. In FIG. 1, a housing 12 of a scroll expander 10A is constituted by a pair of casings 12*a* and 12*b* forming a hollow cylinder. Respective end portions of the casings 12*a* and 12*b* are butted together such that a hollow space is formed in the interior. A discharge port 14 that discharges an expanded working medium w to the exterior of the housing 12 is provided in a site on an end surface outer peripheral side of the casing 12*b*.

Openings 16 and 18 are formed on a central axis of the casings 12*a* and 12*b*, and a single integrated drive shaft 20 having a circular cross-section is disposed to penetrate the openings. A power generator 22 is provided on one end of the drive shaft 20 to be capable of generating power in response to rotation of the drive shaft 20. Sealing packing 24 is inserted between the drive shaft 20 and the openings 16 and 18. Step portions 26*a*, 28*a* and 26*b*, 28*b* are formed on the casings 12*a*, 12*b* in the vicinity of the openings 16, 18, and roller bearings 30*a*, 32*a* and 30*b*, 32*b* are disposed on an inner side of the step portions 26*a*, 28*a* and 26*b*, 28*b*.

A drive scroll body 34 is joined integrally to the drive shaft 20. The drive scroll body 34 is constituted by a pair of divided scroll bodies 34*a* and 34*b*. The divided scroll body 34*a* is constituted by an annular end plate 36*a* and a spiral wrap 38*a* that stands upright from the end plate 36*a* in a perpendicular direction thereto, and an inner peripheral edge of the end plate 36*a* is joined to the drive shaft 20. The divided scroll body 34*b* is constituted by an annular end plate 36*b* and a spiral wrap 38*b* that stands upright from the end plate 36*b* in a perpendicular direction thereto, and an inner peripheral edge of the end plate 36*b* is joined to the drive shaft 20. Respective outer peripheral portions of the divided scroll bodies 34*a* and 34*b* are joined to each other by a bolt 40. An interval into which an end plate 44 of a driven scroll body 42, to be described below, can be inserted is provided between respective tip ends of the wraps 38*a* and 38*b*.

The driven scroll body 42 is constituted by the circular end plate 44, which is disposed between the wraps 38*a*, 38*b*, two spiral wraps 46*a* and 46*b* standing upright from respective surfaces of the endplate 44 in a perpendicular direction thereto, and boss portions 48*a* and 48*b* disposed around the drive shaft 20 on an outer side of the endplates 36*a*, 36*b*. An arm 49*a* is provided integrally with the boss portion 48*a* to extend in a single direction from the boss portion 48*a*, and the arm 49*a* is joined to an outer peripheral portion of the wrap 46*a* by a bolt 50*a*. Similarly, an arm 49*b* is provided integrally with the boss portion 48*b* to extend in a single direction from the boss portion 48*b*, and the arm 49*b* is joined to an outer peripheral portion of the wrap 46*b* by a bolt 50*b*, whereby expansion chambers e1 and e2 are formed on respective surface sides of the end plate 44 in a radial direction of the housing 12 by the end plates 36*a*, 36*b*, 44 and the wraps 38*a*, 38*b*, 46*a*, 46*b* of the drive scroll body 34 and the driven scroll body 42.

The drive shaft 20 is supported by the roller bearings 30*a* and 30*b* rotatably. The boss portion 48*a* of the driven scroll body 42 is supported by the roller bearing 32*a* rotatably, and the boss portion 48*b* is supported by the roller bearing 32*b* rotatably. A rotary axis $C_2$ of the boss portions 48*a* and 48*b* is eccentric from a rotary axis $C_1$ of the drive shaft 20 by t. Therefore, the driven scroll body 42 rotates in a position that is eccentric from the drive shaft 20 by t.

The drive scroll body 34 and the driven scroll body 42 rotate in synchronization and in conjunction with each other via an interlocking mechanism 52. Four interlocking mechanisms 52, for example, are provided at equal intervals around the drive shaft 20. A configuration of the interlocking mechanism 52 will now be described with reference to FIG. 2, taking as an example the interlocking mechanism 52 provided between the arm 49*a* and the divided scroll body 34*a*. In FIG. 2, a cylindrical recessed portion 54 is engraved into the arm 49*a* that opposes the divided scroll body 34*a*. A short axis cylinder 56 is inserted into the recessed portion 54, and a roller bearing 58 is interposed between the short axis cylinder 56 and the recessed portion 54. The roller bearing 58 allows the short axis cylinder 56 to rotate freely within the recessed portion 54.

A circular hole 56*a* is drilled into the short axis cylinder 56 in a region eccentric from a central axis $C_3$ and a circular pin 60*a* forming a pin structure 60 is press-fitted into the hole 56*a*. The pin structure 60 is formed integrally from the pin 60*a*, a large-diameter disc 60*b*, and a cylindrical base portion 60*c*. A boss portion 62 is formed on an outer surface of the endplate 36*a* opposing the short axis cylinder 56, and a cylindrical recessed portion 64 is formed in the boss portion 62. The base portion 60*c* of the pin structure 60 is press-fitted into the recessed portion 64. A central axis $C_4$ of the pin 60*a* is eccentric from the central axis $C_3$ of the short axis cylinder 56 by an offset amount t. The eccentricity amount t is identical to the eccentricity amount t between the rotary axis $C_1$ of the drive shaft 20 and the rotary axis $C_2$ of the boss portion 48*a*.

A working medium introduction hole 66 is drilled into the drive shaft 20 in an axial direction. One end of the working medium introduction hole 66 opens onto an end surface 20*a* of the drive shaft 20, and a radial direction hole 68 is formed consecutively with the other end. An opening 68*a* of the radial direction hole 68 opens onto a radial direction central portion of the expansion chambers e1 and e2. A recessed portion 44*a* is formed in the end plate 44 in a site opposing the drive shaft 20, to allow conjunct eccentric motion of the driven scroll body 42 relative to the drive shaft 20, and a gap s is formed between the recessed portion 44*a* and the drive shaft 20. The opening 68*a* in the radial direction hole 68 opens onto the gap s in an intermediate position between the endplates 36*a* and 36*b* so as to straddle the endplate 44 evenly. Further, a cover 70 is provided on the end surface 20*a* of the drive shaft 20, and a working medium introduction hole 72 is provided in the cover 70.

With this configuration, when the high-pressure working medium w is introduced into the expansion chambers e1 and e2 through the working medium introduction holes 72 and 66, the drive scroll body 34 and the driven scroll body 42 are rotated synchronously by an expansion force of the working medium w, causing the drive shaft 20 to rotate. When the drive shaft 20 rotates, the power generator 22 connected to the drive shaft 20 generates power. After expanding in the expansion chambers e1, e2, the working medium w is discharged to the outside of the housing 12 through the discharge port 14.

According to this embodiment, the double expansion chambers e1 and e2 are formed, and therefore a supply amount of the working medium w can be increased, enabling an increase in the rotary torque exerted on the drive shaft 20, whereby an amount of power generated by the power generator 22 can be increased. Further, by forming the expansion chambers e1 and e2 on the respective sides of the end plate 44, a thrust force exerted on the drive scroll body 34 and the driven scroll body 42 can be canceled out, and therefore a support structure for the drive scroll body 34 and the driven scroll body 42 can be simplified. Moreover, by employing the simply configured interlocking mechanism 52, the torque required to rotate the drive scroll body 34 and the driven scroll body 42 can be reduced, enabling a corresponding increase in the amount of power generated by the power generator 22.

Furthermore, the drive shaft 20 is constituted by a single integrated drive shaft penetrating the double expansion chambers e1, e2, and therefore axial center alignment is not required. Moreover, by providing the working medium introduction hole 66 in this penetrating shaft, an introduction hole which exhibits a favorable sealing property and in which pre-expansion due to a temperature reduction does not occur can be formed. Hence, the high-pressure working medium w can be supplied to the double expansion chambers e1, e2 such that a reduction in the output of the scroll expander 10A does not occur. Furthermore, by forming the drive shaft 20 from a single penetrating shaft, positioning of the radial direction hole 68 can be facilitated, and by providing the opening 68*a* of the radial direction hole 68 to open onto the gap s in a position straddling the end plate 44 evenly, the working medium w can be supplied to the expansion chambers e1 and e2 evenly. Hence, only the single opening 68*a* need be provided, and therefore the machining man-hour required to form the radial direction hole 68 can be reduced.

Further, the boss portions 48*a*, 48*b* of the driven scroll body 42 and the end plates 36*a*, 36*b* are joined via the arms 49*a*, 49*b*, and therefore a housing that covers the entire expansion chamber formation region, such as that described in Japanese Patent Application Publication No. H6-341381, is not required, whereby the weight of the driven scroll body 42 can be reduced. Accordingly, the amount of driving force required to rotate the driven scroll body 42 can be reduced, enabling a corresponding increase in the amount of power generated by the power generator 22. Note that in this embodiment, the drive shaft 20 is a penetrating shaft, and therefore a large expansion ratio cannot be secured in the expansion chambers e1, e2. In a binary power generation system, however, a large expansion ratio is not necessary.

(Second Embodiment)

Figure 3:
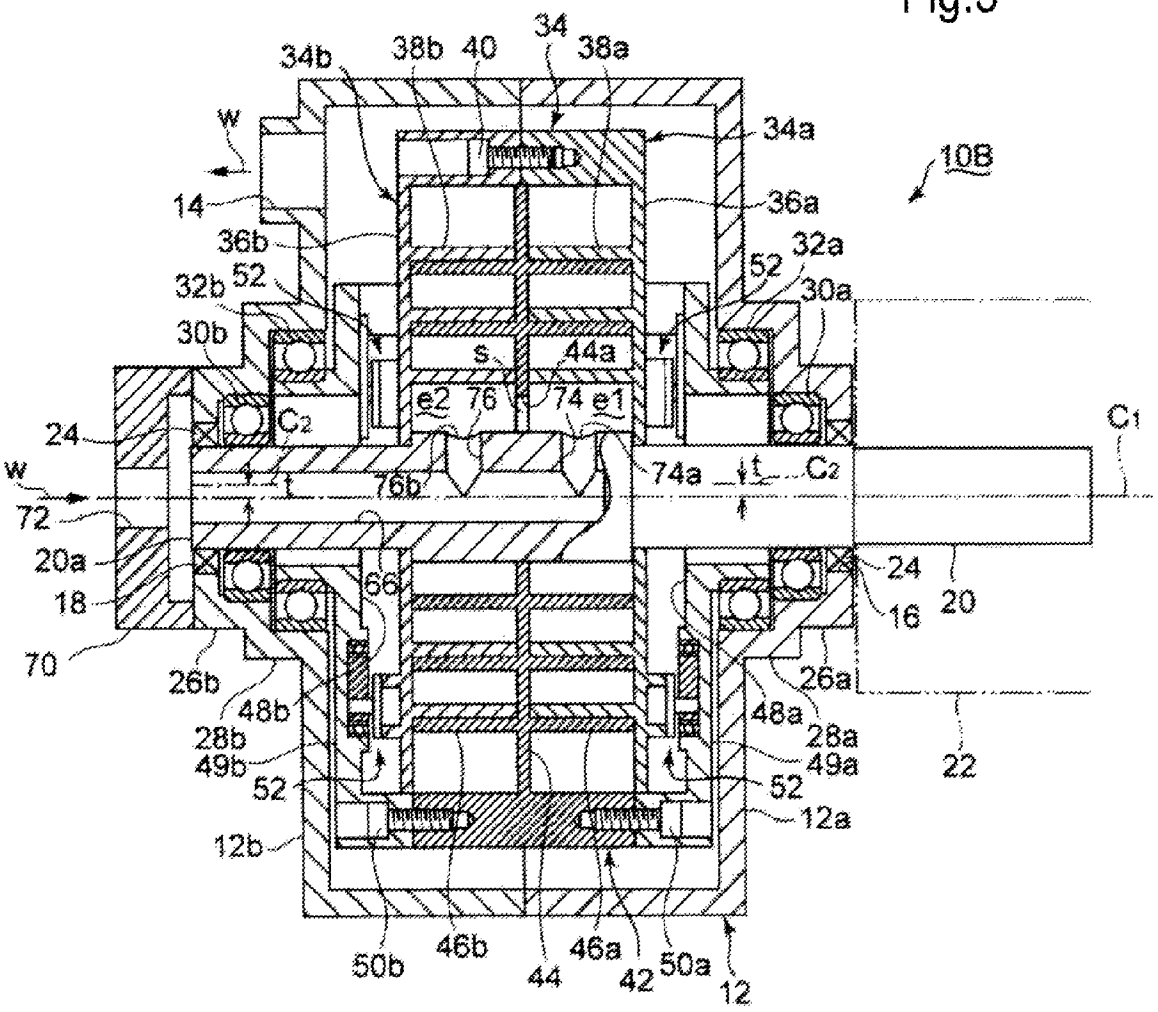
FIG. 3 is a front sectional view of a scroll expander according to a second embodiment of the present invention.

Next, a second embodiment of the present invention will be described using FIG. 3. In a scroll expander 10B according to this embodiment, two radial direction holes 74 and 76 opening respectively onto the expansion chambers e1 and e2 are formed consecutively with the working medium introduction hole 66. An opening 74*a* of the radial direction hole 74 opens onto an axial direction center of the expansion chamber e1, and an opening 76*a* of the radial direction hole 76 opens onto an axial direction center of the expansion chamber e2. An opening area of the opening 74*a* and an opening area of the opening 76*a* are identical. All other configurations are identical to the first embodiment.

According to this embodiment, a supply amount of the working medium w supplied to the expansion chamber e1 through the radial direction hole 74 and a supply amount of the working medium w supplied to the expansion chamber e2 through the radial direction hole 76 can be made equal. Further, in contrast to the first embodiment, there is no need to dispose the opening 68 toward the gap s, and therefore design freedom can be increased in relation to disposal arrangements and disposal directions of the radial direction holes 74, 76 and the openings 74*a*, 76*a* thereof.

According to the present invention, in a double rotation type scroll expander having double expansion chambers, a working medium supply passage exhibiting a favorable sealing property can be formed, the need for axial center alignment of a drive shaft can be eliminated, and a working medium can be supplied evenly to the double expansion chambers.

What is claimed is:

1. A scroll expander, comprising:

a drive shaft;

a drive scroll body provided integrally with the drive shaft;

a driven scroll body having a rotary axis that is eccentric relative to a rotary axis of the drive shaft;

an interlocking mechanism that causes the drive scroll body and the driven scroll body to rotate synchronously;

a first bearing that supports the drive shaft rotatably relative to a fixed frame; and a second bearing that supports the driven scroll body rotatably relative to the fixed frame, wherein the drive scroll body includes two first end plates disposed on both sides of the driven scroll body and a spiral-shaped first wrap that projects inward respectively from the two first end plates, the driven scroll body includes a second end plate disposed between the two first end plates and a second wrap projecting from respective surfaces of the second end plate, an expansion chamber is formed on both sides of the second end plate by the end plates and the wraps of the drive scroll body and the driven scroll body, the drive shaft is comprised of a single drive shaft penetrating the expansion chamber, and the working medium introduction hole is provided in the drive shaft and is communicated with a radial direction central portion of the expansion chamber a gap that allows conjunct eccentric motion of the driven scroll body relative to the drive scroll body is formed between the second end plate of the driven scroll body and the drive shaft, and an opening of the working medium introduction hole is disposed in a position facing the gap and straddling the second end plate evenly.

2. A scroll expander, comprising:

a drive shaft;

a drive scroll body provided integrally with the drive shaft;

a driven scroll body having a rotary axis that is eccentric relative to a rotary axis of the drive shaft;

an interlocking mechanism configured to cause the drive scroll body and the driven scroll body to rotate synchronously;

a first bearing that supports the drive shaft rotatably relative to a fixed frame; and a second bearing that supports the driven scroll body rotatably relative to the fixed frame, wherein the drive scroll body includes two first end plates disposed on both sides of the driven scroll body, and a spiral-shaped first wrap that projects inward respectively from the two first end plates, the driven scroll body includes a second end plate disposed between the two first end plates, and a second wrap projecting from respective surfaces of the second end plate, an expansion chamber is formed by the first and second end plates and the first and second wraps of the drive scroll body and the driven scroll body, the drive shaft is a single drive shaft penetrating the expansion chamber, a working medium introduction hole is provided in the drive shaft and extending along a lengthwise direction of the drive shaft, a plurality of radial introduction holes are formed in the scroll expander such that, each of the plurality of radial introduction holes opens into the expansion chamber in a direction substantially perpendicular to the working medium introduction hole to connect the working medium introduction hole with the expansion chamber a gap that allows conjunct eccentric motion of the driven scroll body relative to the drive scroll body is formed between the second end plate of the driven scroll body and the drive shaft, and an opening of the working medium introduction hole is disposed in a position facing the gap and straddling the second end plate evenly.

* * * * *